US005493070A

United States Patent [19]

Habu

[11] Patent Number: 5,493,070

[45] Date of Patent: Feb. 20, 1996

[54] MEASURING CABLE AND MEASURING SYSTEM

[75] Inventor: Satoshi Habu, Hachioji, Japan

[73] Assignee: Hewlett-Packard Company, Palo Alto, Calif.

[21] Appl. No.: 262,773

[22] Filed: Jun. 20, 1994

[30] Foreign Application Priority Data

Jul. 28, 1993 [JP] Japan ..... 5-205834

[51] Int. Cl.[6] ..... H01B 11/18

[52] U.S. Cl. ..... 174/102 R; 174/105 R; 324/158.1; 324/765

[58] Field of Search ..... 174/102 R, 105 R, 174/105 B, 36; 324/765

[56] References Cited

U.S. PATENT DOCUMENTS

| | | | |
|---|---|---|---|
| 1,701,279 | 2/1929 | Silbermann . | |
| 2,191,995 | 2/1940 | Scott et al. | 174/36 |
| 2,376,101 | 5/1945 | Tyzzer | 174/36 |
| 3,193,712 | 7/1965 | Harris | 307/147 |
| 3,484,679 | 12/1969 | Hodgson et al. | 174/102 R |
| 3,542,938 | 11/1970 | Graneau | 174/28 |
| 4,376,920 | 3/1983 | Smith | 333/12 |
| 4,467,275 | 8/1984 | Maeda et al. | 324/73 AT |
| 4,487,996 | 12/1984 | Rabinowitz et al. | 174/105 R |
| 4,544,879 | 10/1985 | Maeda et al. | 324/57 R |
| 4,701,701 | 10/1987 | Takagi | 324/158 R |
| 4,840,563 | 6/1989 | Altendorf | 433/29 |
| 5,095,891 | 3/1992 | Reitter | 128/240 EL |
| 5,140,442 | 9/1992 | Desmons | 385/101 |
| 5,389,990 | 2/1995 | Nakamura | 324/158.1 |

FOREIGN PATENT DOCUMENTS

| | | | |
|---|---|---|---|
| 47239 | 2/1937 | France | 174/105 R |

OTHER PUBLICATIONS

HP4142B Modular DC Source And Monitor Operation Manual, Yokogawa Hewlett–Packard, Feb. 1990, pp. C–7 to C–8.

*Primary Examiner*—Morris H. Nimmo

[57] ABSTRACT

A cable is provided that is suitable for Kelvin connection and a measuring system for using the cable. The cable comprises a central conductor for current supply to an object to be measured, a voltage detection conductor insulated and located close to the central conductor, a tubular guarding conductor surrounding the above two conductors covered by insulating material and a tubular conductor for a reference potential surrounding the above-mentioned conductors (as covered by an insulating material).

4 Claims, 4 Drawing Sheets

MEASURING CABLE AND MEASURING SYSTEM

FIELD OF THE INVENTION

The present invention relates to a measuring cable used in electronic equipment such as a semiconductor measuring apparatus or the like, and a voltage/current measuring apparatus and voltage/current measuring method using such a cable. The invention relates to technology for highly precisely and stably measuring various electrical characteristics, such as a voltage-current characteristic or the like, of an object to be measured (DUT).

DESCRIPTION OF THE PRIOR ART

FIG. 1 shows an outline of a voltage/current characteristic measuring unit (SMU) 100 applied to a conventional semiconductor testing apparatus (for example, a semiconductor characteristic measuring apparatus such as HP4145 or the like made by the Hewlett-Packard Corp., U.S.). This unit is capable of voltage setting/current measurement and/or current setting/voltage measurement and its architecture is widely used by the present applicant in IC (integrated circuit) testers or IC characteristic evaluation apparatus which are available in the market.

An error amplifier 111 is connected to one end "a" of a current measuring resistor 120 through an integrator 112 and a buffer 113. Error amplifier 111, integrator 112 and buffer 113, together, constitute a signal generator 110.

The other end "b" of current measuring resistor 120 is connected directly to a predetermined terminal of the DUT (not shown) or connected thereto through a measuring cable terminal f. Each of two ends of the resistor 120 is respectively connected to each of two input terminals of a differential amplifier 132 through buffers 131*a* and 131*b*. An output terminal of the differential amplifier 132 and an output terminal of the buffer (131*b*) which is connected to the terminal of the resistor 120 on the DUT side are respectively connected to corresponding inputs of the above-described error amplifier 111.

A resistor (several kΩ) 121 is connected between the other end b of the current measuring resistor 120 and the buffer 131*b* and, in an embodiment of the invention, serves to suitably maintain an operating point of the SMU even if the terminals s and f are separated from each other.

Here, a current measuring circuit is constituted by the buffers 131*a* and 131*b* and the differential amplifier 132, and a voltage measuring circuit is constituted by the buffer 131*b*.

Where performing the voltage setting/current measurement, voltage ($V_{FIN}$) is supplied to the error amplifier 111 in the form of an analog voltage from a measurement signal processing circuit (not shown) through a DAC (not shown). The error amplifier 111 feeds back the voltage $V_{OUT}$ at the terminal b of the current measuring resistor 120 on the DUT side, and compares the $V_{FIN}$ with $V_{OUT}$, to thereby output an error signal to the integrator 112 so that the $V_{OUT}$ and $V_{FIN}$ are equal to each other.

The current that flows through the current measuring resistor 120 (i.e. the current supplied to the DUT) can be found by measuring the voltage between both terminals a and b of the resistor 120. The voltage between a and b is extracted as an output voltage of the differential amplifier 132. The voltage is fed to the above-described measurement signal processing circuit through an ADC (not shown).

Also, when performing the current setting/voltage measurement, from the above-described measurement signal processing circuit, a current signal ($I_{FIN}$) is supplied to the error amplifier 111 through the above-described DAC. The error amplifier 111 feeds back the voltage between both terminals of the resistor 120 and outputs an error signal to the integrator 112 so that the current that flows through the resistor 120 (i.e., current supplied to the DUT) is equal to the current $I_{FIN}$. The voltage applied to the DUT may be found by measuring the voltage at the terminal b on the DUT side. This voltage is fed through the above-described ADC to the above-described signal circuit.

However, if the DUT is connected through the measuring cable as shown in FIG. 2, there will be errors in current measurement and voltage measurement.

For instance, due to the presence of a resistance 122 of the measuring cable, the potential of the terminal b is different from the potential of a terminal $t_1$ of the DUT and the current flowing through the resistor 120 is different from the current flowing through the terminal $t_1$ of the DUT by a leak current i.

In order to solve the above problems, a so-called Kelvin connection and a guard technique are used. The input terminal s of the buffer 131*b* shown in FIG. 1 is connected to the terminal $t_1$ to thereby avoid voltage errors caused by the resistor 122 shown in FIG. 2.

A conductor which covers, via an insulating material, the cable extending from the terminals f and s to the DUT, is provided. The conductor is connected to an output terminal g of the buffer 131*b* so that the potential of the conductor is substantially equal to the potential of the cable extending from the terminals f and s. With this arrangement, leakage current i of FIG. 2 is reduced. Furthermore, if a ground terminal and is provided and connected to the conductor which covers the cable as a whole, noise caused by external radio waves or induction is prevented from entering the cable, thereby avoiding the generation of measurement errors.

FIG. 3 shows one example of the prior art which realizes the above-described structure. In the figure, three-core coaxial cables $LN_1$ and $LN_2$ are connected to external terminals F, S, G and GND which correspond, respectively, to the above-described internal terminals f, s, g and gnd of the SMU. The terminals F and S are finally connected to one of the terminals $t_1$ of the DUT through the respective cables and are subjected to the Kelvin connection. The current is supplied from the terminal F to the DUT, and the potential of DUT is detected at the terminal S. The conductors from the respective terminals F and S are guarded by the respective conductors separately connected to the terminal G and are shielded by conductors connected to the terminal GND.

The other terminal $t_2$ of the DUT is connected to another SMU. Typically, one of the conductors is connected to GND of the SMU and the potential at the terminal $t_2$ is detected by the other of the conductors.

In the arrangement shown in FIG. 3, two three-core cables are needed for one terminal of the DUT. In the case where there are many terminals to be measured, the arrangement suffers from difficulties in wiring and the handling thereof.

In FIG. 4, the SMU 100 and the DUT are connected to each other through a four-core coaxial cable 200 to thereby reduce the number of cables. This is the case even if the terminals F and S are interchanged. However, the cable becomes thicker, resulting in the disadvantage of loss of flexibility.

Also, the arrangement shown in FIG. 3 and the arrangement shown in FIG. 4 suffer from a problem in that the capacitance between the terminals G and F or S, i.e. guard capacitance Cg, is large.

As is apparent from FIG. 1, the capacitance Cg is imposed between the terminals f and g or between the terminals s and g, feedback amount of high frequency band in a feedback loop of the SMU is reduced, and a phase shift amount is increased, degrading the stability of the SMU, as a result of which, variations in measurement values occur.

In the prior art examples, in case of FIG. 3 where the three-core coaxial cables were used, Cg was typically 140 pF, and in the case of FIG. 4 where the four-core coaxial cable was used, Cg was typically 120 to 130 pF. Although Cg per one three-core coaxial cable was small at 70 pF, since two cables were connected in parallel, Cg increases. With the four-core coaxial cable, in order to retain flexibility, it was necessary to reduce thickness of the cable to the same as of the three-core coaxial cable. If the four-core coaxial cable is made so thin, Cg may increase.

OBJECT OF THE INVENTION

Accordingly, an object of the present invention is to solve the above-described problems by means of a measuring cable used for Kelvin connection with a low guard capacitance and by a measuring system for voltages, currents, etc. using the cable.

SUMMARY OF THE INVENTION

In the measuring cable which embodies the present invention, by taking into consideration the fact that in a conventional four-core coaxial cable the current that flows through a voltage detection conductor is small, by greatly reducing the diameter of the voltage detection conductor, the guard capacitance Cg is reduced, with the cable diameter unchanged. Measurement with a SMU is carried out by using the measuring cable with low guard capacitance, whereby measurement values which are free from variation may be insured.

DETAILED DESCRIPTION OF THE INVENTION

Figure 5:
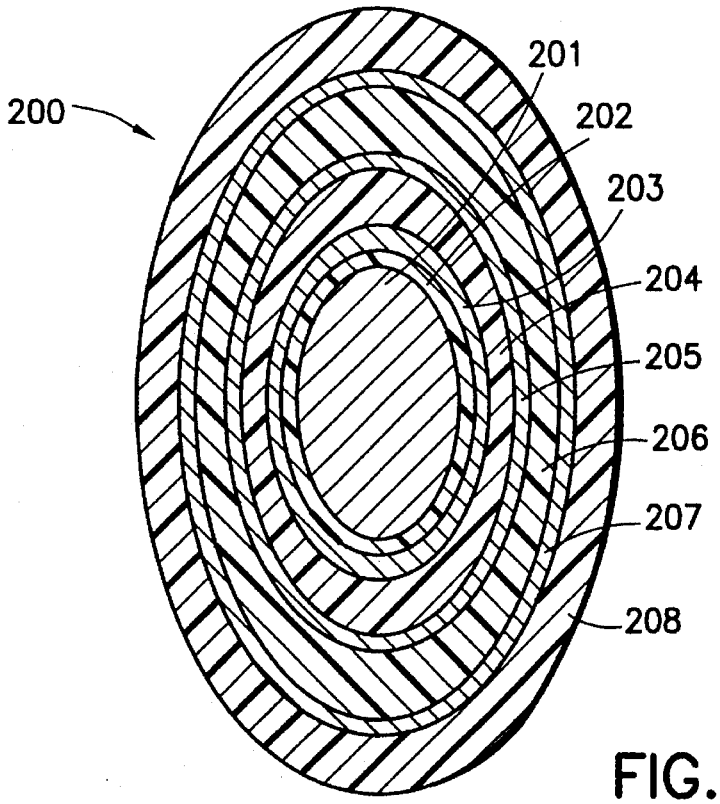
FIG. 5 PRIOR ART
FIG. 5 is a cross section of a conventional four-core coaxial cable.
Figure 6:
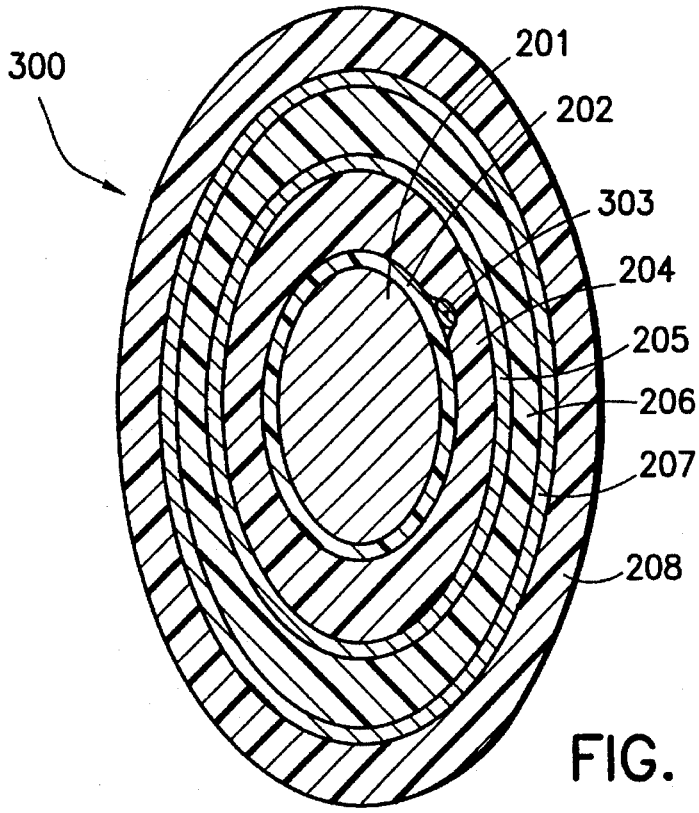
FIG. 6 is a cross section of a determination cable of an example of this invention.

FIG. 6 is a cross-sectional view showing a measuring cable 300 according to one embodiment of the invention. FIG. 5 is a cross-sectional view showing a conventional four-core coaxial cable 200. The same reference numerals are used to indicate components having the same functions.

In FIG. 5, conductors 201, 203, 205 and 207 are arranged separately and coaxially via insulating materials 202, 204 and 206. An insulating material 208 is an outer coating serving to protect the cable.

In an operating state, the conductors 201 and 203 are kept at substantially the same potential. Therefore, a capacitance Cg between the conductors 205 and 203 connected to the guard electrode G is given by the following formula with an outer diameter $R_3$ of the conductor 203 and an inner diameter $R_4$ of the conductor 205:

$$Cg=2\pi\epsilon/\log(R_5/R_3)$$

where $\pi$ is the circular constant (3.14159), and $\epsilon$ is the dielectric constant (for example, 2.0×8.854 pF/m for Teflon).

In the typical example, $R_5/R_3=2.3$ and Cg=134pf/m are given. In FIG. 6, the conductor 203 is changed from a tubular shape to a single line conductor 303. The conductor 303 is used to detect the voltage in use and its inductance does not largely affect the measuring system. Accordingly, the conductor is sufficiently thin and is arranged close to the conductor 201. In the preferred embodiment, the diameter of the conductor 201 is 0.45 mm, the thickness of the insulating material 202 is 0.1 mm, the diameter of the conductor 303 is 0.16 mm and the outer diameter of the insulating material 204 is 2.77 mm.

The nature of Cg is the coaxial capacitance due to the conductor 201 and the conductor 205. Under the same outer diameter measurement as that of the prior art example ($R_5/R_3$ is around 6.16), the calculated value of Cg is 61.2 pF/m. However, there is the effect of the conductor 303 and the like and production variations. Thus, the actual value thereof was 62 to 70 pF/m.

In the preferred embodiment of the present invention, the insulating materials 202, 204 and 206 are made of Teflon, and the insulating material 208 is made of polyvinyl chloride. The outer diameter is 4.7 mm, which is substantially the same as that of the prior art three-core coaxial cable.

As is apparent from FIG. 6, it is possible to integrally mold the insulative materials 202 and 204. Also, it is possible to effect a low-noise cable treatment such as a carbon powder agent between the conductor 205 and the insulating material 204.

Figure 1:
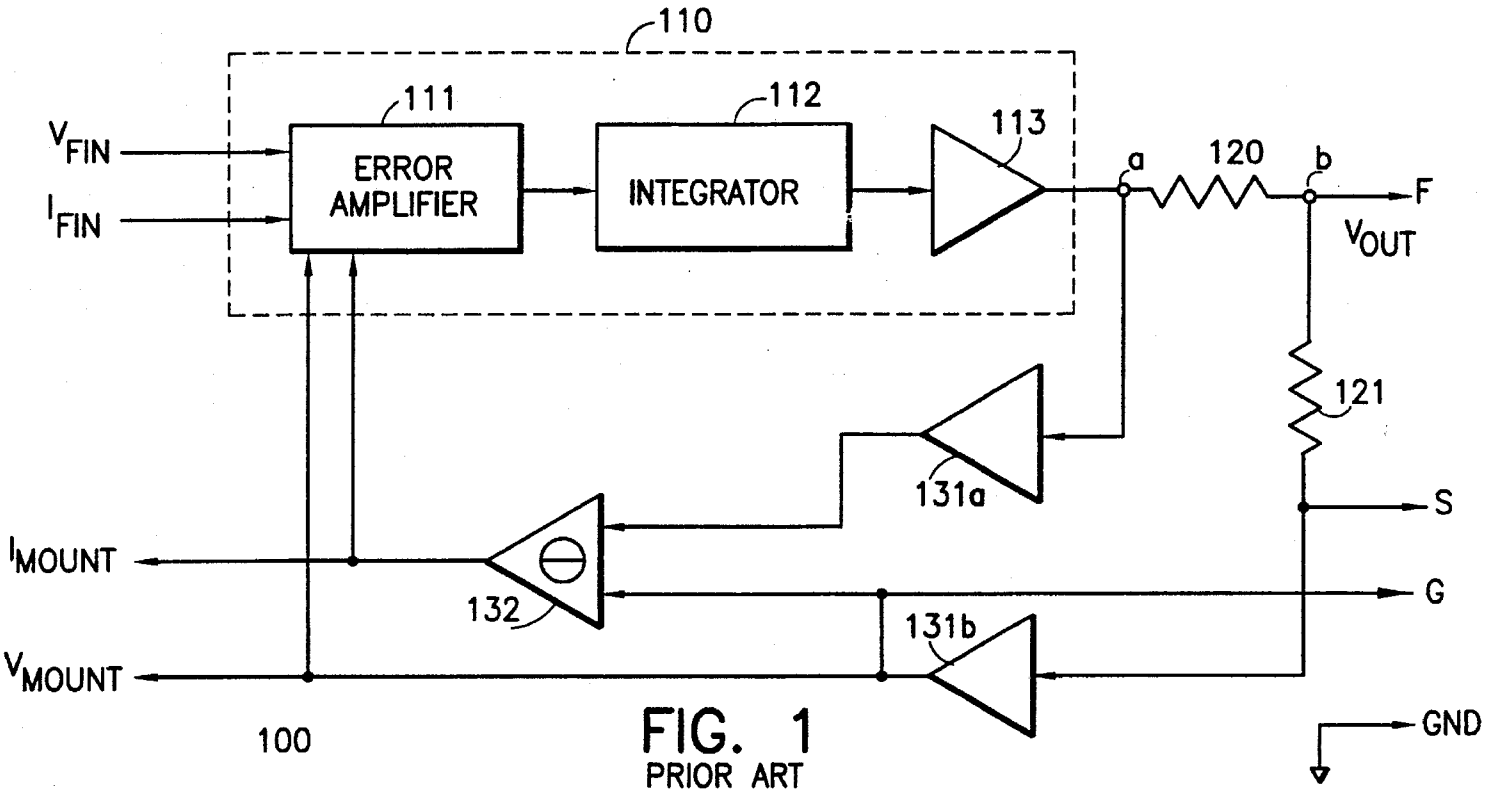
FIG. 1 PRIOR ART
FIG. 1 is a circuit diagram of the voltage-current property determination unit (SMU) used in one example of the determination system of this invention.
Figure 2:
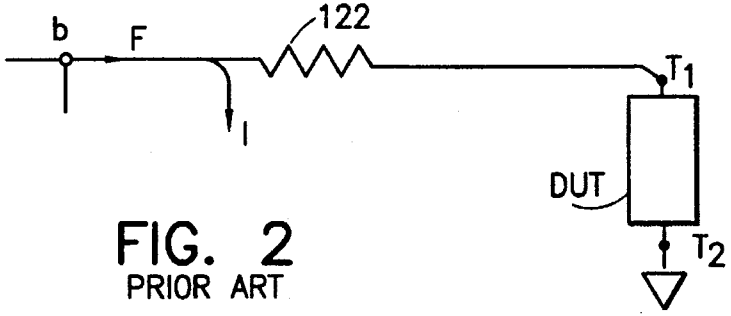
FIG. 2 PRIOR ART
FIG. 2 is a circuit diagram that explains the generation of determination errors with a determination cable when determinations are performed using an SMU.
Figure 3:
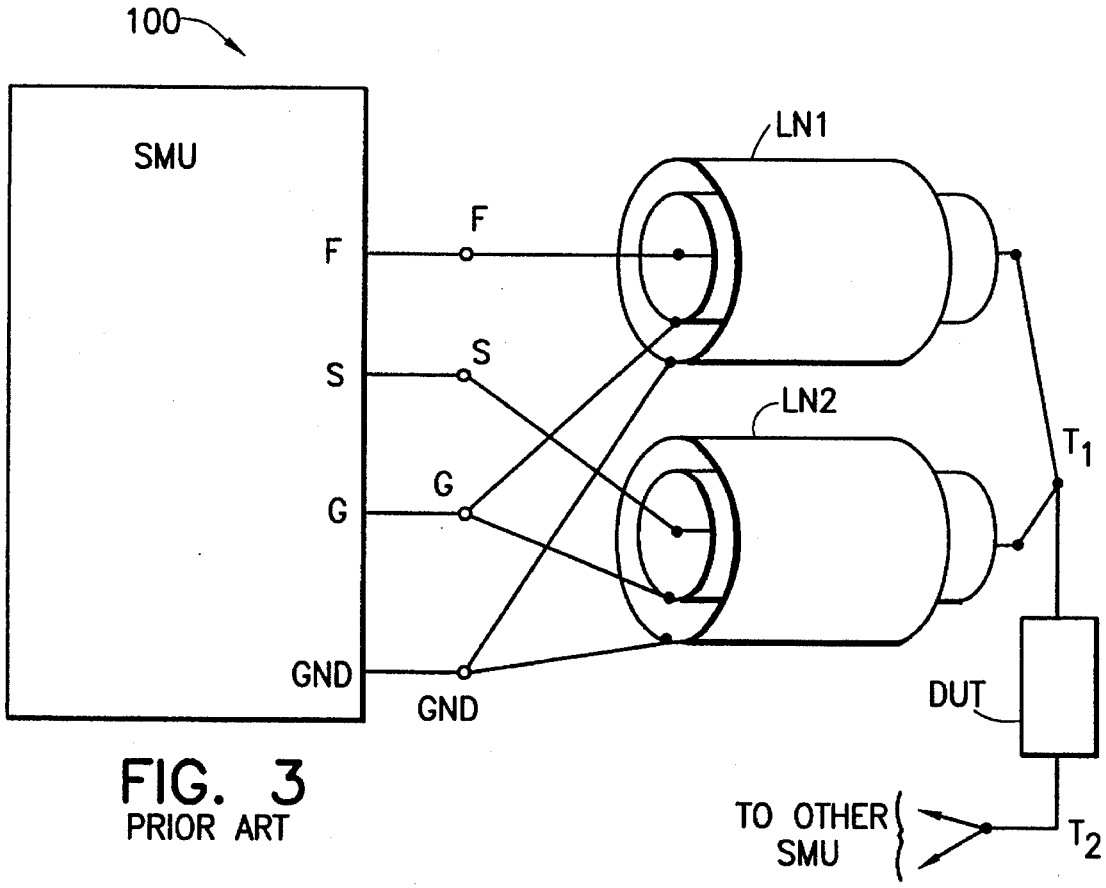
FIG. 3 PRIOR ART
FIG. 3 is a block diagram showing the connection of a conventional determination system that uses an SMU and a three-core coaxial cable.
Figure 4:
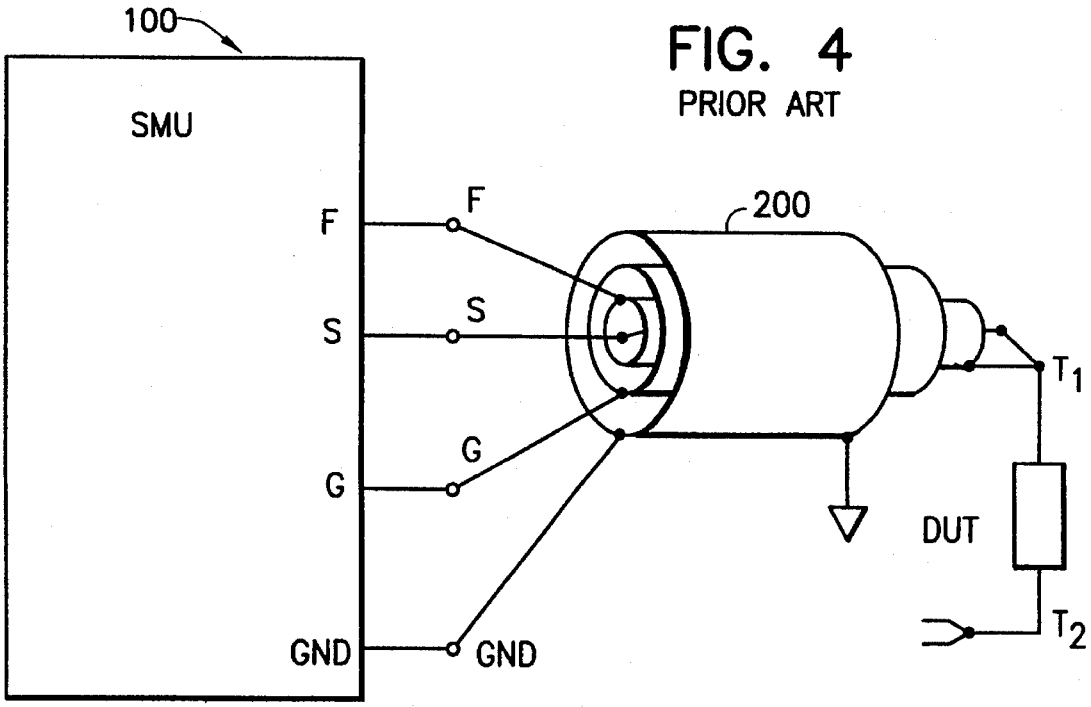
FIG. 4 PRIOR ART
FIG. 4 is a block diagram showing the connection of a conventional determination system that uses an SMU and a four-core coaxial cable.
Figure 7:
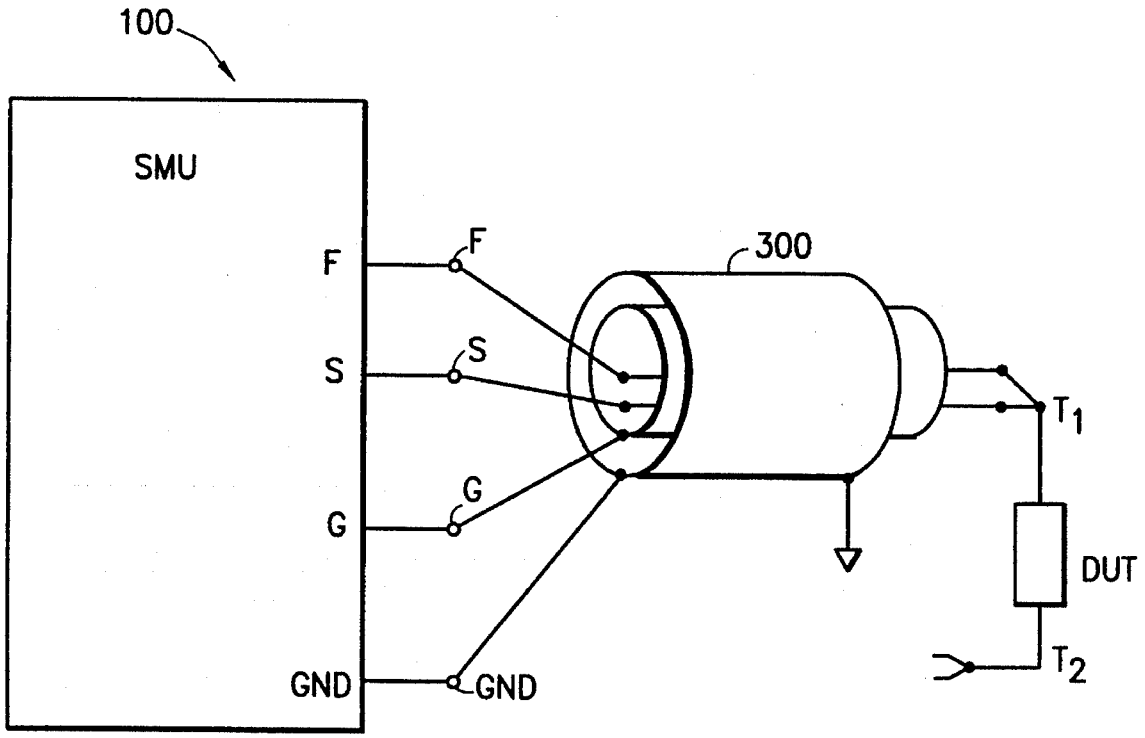
FIG. 7 is a block diagram of a determination system of an example of this invention.

When the cable shown in FIG. 6 is to be used for measurement with the SMU 100, electrical connections are as shown in FIG. 7. Namely, at one end of the measuring cable 300, the terminals F, S, G and GND are respectively connected to the conductors 201, 303, 205 and 207. At the other end thereof, the conductors 202 and 303 are connected to the terminal $t_1$ of the DUT. As a rule, the conductor 207 is grounded during use. In FIG. 7, insulating materials have been omitted from the illustration in the same manner as in FIGS. 3 and 4.

EFFECTS OF THE INVENTION

As has been described in detail, in the measuring cable in accordance with the present invention, the capacitance between the third conductor to be used for guard and the first and second conductors is smaller than the capacitance accompanying the guarded Kelvin connection measurement using conventional four-core or three-core coaxial cable. It is also possible to reduce the outer dimension, therefore, the flexibility of the measurement cable is not degraded.

Accordingly, in measurement with such a measuring cable and SMU, the number of cables is small, cable arrangement is easy and measurement variations can be suppressed.

I claim:

1. A measuring cable comprising, (a) a first conductor wire extending a predetermined length, (b) a first insulating material for covering said first conductor wire, (c) a second conductor wire disposed on said first insulating material and extending together with said first conductor wire, (d) a second insulating material for covering said first insulating material and said second conductor wire and extending together with said second conductor wire, (e) a third conductor sheath covering said second insulating material and extending together with said second insulating material, and (f) a fourth conductor sheath covering a third insulating material positioned about said third conductor sheath and extending together with said third conductor, said second conductor wire having a sufficiently small cross section so as not to substantially change a static capacitance between said first conductor wire and said third conductor sheath.

2. The measuring cable according to claim 1, wherein said first and said second insulating materials are integrally formed.

3. A measuring system comprising:

a measuring cable including a first conductor wire, a first insulating material covering said first conductor wire, a second conductor wire disposed on said first insulating material, a second insulating material for covering said first insulating material and said second conductor wire, a third conductor sheath covering said second insulating material, and a fourth conductor sheath covering a third insulating material positioned about said third conductor sheath, said second conductor wire having a sufficiently small cross section so as not to substantially change static capacitance between said first conductor wire and said third conductor sheath;

connecting means at one end of said measuring cable for connecting said first conductor wire and said second conductor wire to an electrode of an element to be measured; and a voltage/current characteristic measuring unit connected to another end of said measuring cable, for supplying said first conductor wire with a measurement current, detecting a potential on said second conductor wire, and for driving said third conductor sheath so that a potential of said third conductor sheath is substantially equal to the detected potential.

4. The measuring system according to claim 3, wherein said fourth conductor sheath is grounded at both ends of said measuring cable.

* * * * *